US005243845A

United States Patent [19]

Velte

[11] Patent Number: 5,243,845

[45] Date of Patent: Sep. 14, 1993

[54] FLARING TOOL FOR HOLLOW WORKPIECES

[75] Inventor: Karl-Heinz Velte, Weilrod, Fed. Rep. of Germany

[73] Assignee: Rothenberger Werkzeuge-Maschinen GmbH, Kelkheim, Fed. Rep. of Germany

[21] Appl. No.: 822,002

[22] Filed: Jan. 16, 1992

[30] Foreign Application Priority Data

Feb. 12, 1991 [DE] Fed. Rep. of Germany ..... 4104205

[51] Int. Cl.[5] ..... B21D 39/20

[52] U.S. Cl. ..... 72/393; 72/482

[58] Field of Search ..... 72/393, 482; 411/114, 411/115, 140, 141

[56] References Cited

U.S. PATENT DOCUMENTS 1,238,012 8/1917 Hall ..... 411/115
1,717,668 6/1929 Dhaenens ..... 411/140
4,735,078 4/1988 Wesebaum ..... 72/393

FOREIGN PATENT DOCUMENTS 0252868 1/1988 European Pat. Off. .
2511490 9/1976 Fed. Rep. of Germany .
2616324 10/1977 Fed. Rep. of Germany .
8800503 9/1988 Fed. Rep. of Germany .
8807784.5 9/1988 Fed. Rep. of Germany .
3826187 2/1990 Fed. Rep. of Germany .
1485098 9/1977 United Kingdom .

*Primary Examiner*—Lowell A. Larson
*Attorney, Agent, or Firm*—Felfe & Lynch

[57] ABSTRACT

A flaring tool (1) for hollow workpieces having a basic tool body (2) with an expanding mandrel (13), which can be displaced by means of a drive. A supporting device (5) concentrically surrounding the expanding mandrel with an exchangeable expansion head (6) which has radially movable expanding jaws (14) located in a screw cap (16). The supporting device (5) is placed in the basic tool body (2) and can be moved longitudinally by means of a threaded extension (8) in the direction of the (A—A) axis of the expanding mandrel (13), and has an annular flange (11) which serves as a stop (10) for the expansion head. The supporting device (5) is fixed opposite the basic tool body (2) by means of a stopping device. In order to achieve a simple, reliable and reproducible set-up the supporting device (5) has in its annular flange (11), in a circle placed concentrically to the (A—A) axis, index boreholes for an index pin (29), located in the basic tool body (2).

4 Claims, 1 Drawing Sheet

FIG. 1
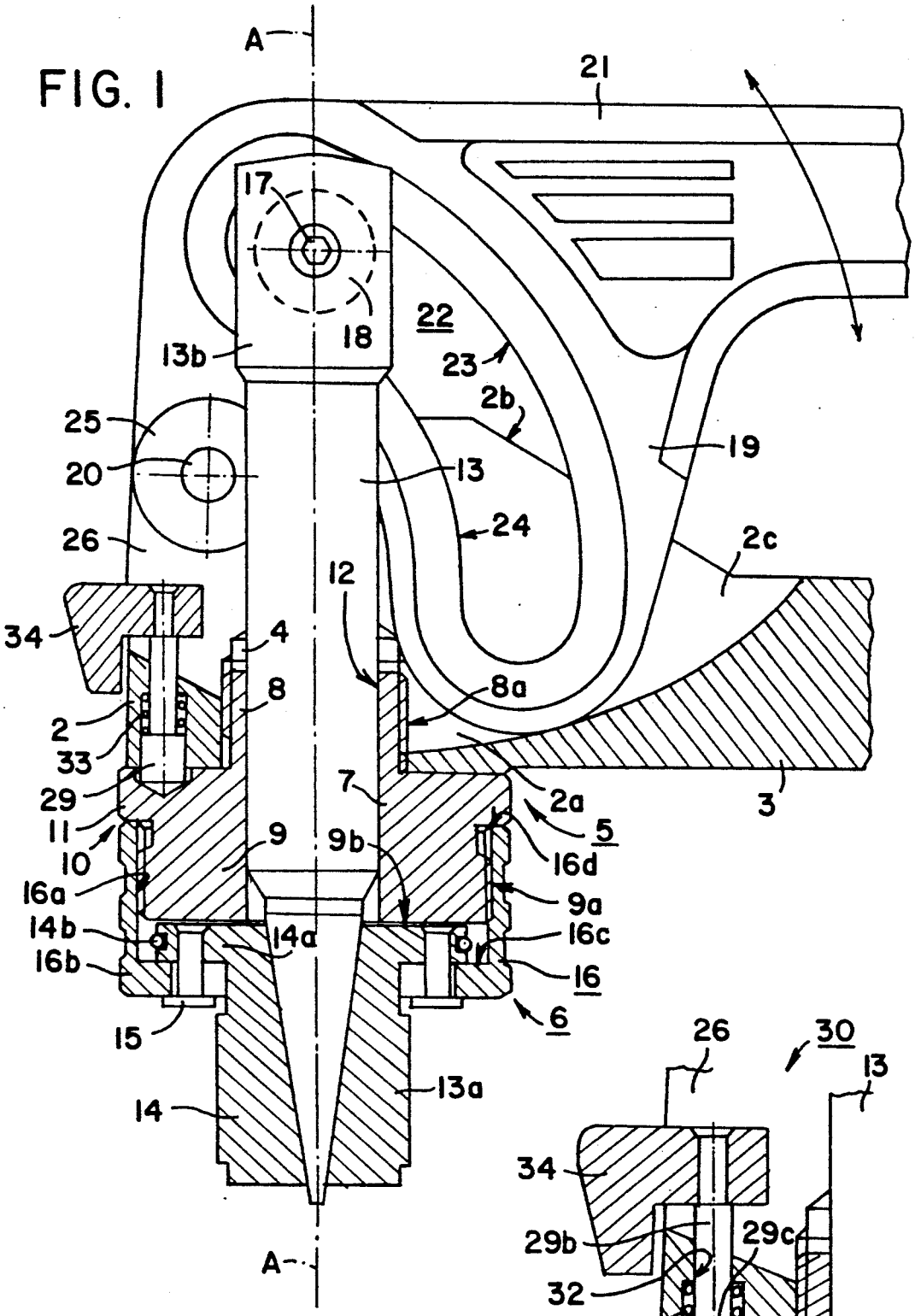
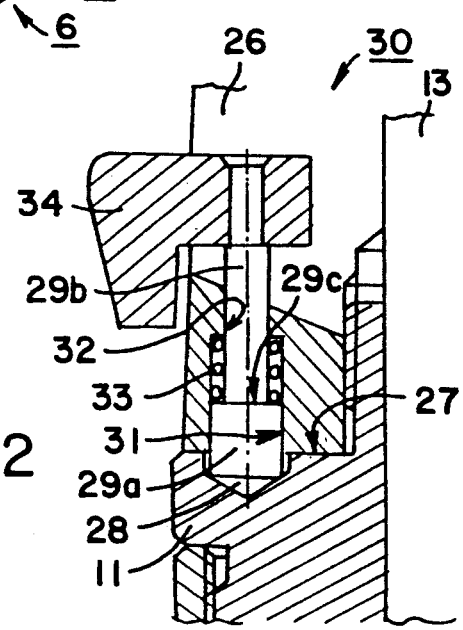
FIG. 2

FLARING TOOL FOR HOLLOW WORKPIECES

The invention refers to a flaring tool for hollow,,in particular cylindrical hollow workpieces, having a basic tool body with an axially displaceable expanding mandrel with a tapered end, a supporting device for an exchangeable expansion head, concentrically surrounding the expanding mandrel, a drive allowing displacement of the expanding mandrel at a preset stroke against the expansion head, comprising a screw cap which can be mounted on the supporting device and of a set of expanding jaws which can be guided radially inside the screw cap, and in which tool the supporting device is placed in the basic tool body in such manner that it can be adjusted longitudinally in the direction of the (A—A) axis of the expanding mandrel by means of a threaded extension and which supporting device has an annular flange serving as a stop for the expansion head, and a stopping device which acts on the adjusting movement of the supporting device opposite the basic tool body.

A flaring tool is known from DE-OS 38 26 187 in which the supporting device for the expansion heads forms one piece with the basic tool body, being built in the form of a threaded extension of the same. In order to achieve an axial set-up of the expansion heads in one of the examples, a stop ring is located on the accordingly extended threaded extensions of the basic tool body, which can be secured with an index pin. Since in this case the screw cap denominated jaw retainer ring can be at different distances from the lower frontal area of the threaded extension, an adaptor ring must be screwed into the jaw supporting ring in order to ensure a defined guiding slit for the flange areas of the individual expanding jaws, the adaptor ring being secured against twisting turning with a slotted pin.

The use of an adapter ring is however limited to jaw supporting rings with correspondingly large diameters, which cannot be screwed onto the threaded extension without an adaptor ring, for which there is a standard size on the market in order to facilitate back-orders and replacements of expansion heads. The minimum diameter of the pipes to be expanded are therefore approximately 28 mm, because of the diameter enlargement caused by the adaptor ring. Therefore, the known solution cannot be used in the vast majority of cases for residential plumbing, where pipe diameters are definitely under 28 mm.

A flaring tool of the above described type is known from DE-GM 88 07 784.5, in which the stopping device consists of a headless screw radially placed in the basic tool body, which can be braced against the thread free end of the supporting device.

This allows an adjustment, but the headless screw is susceptible to wear, and does not allow reproducing a useful setting. B necessity the point of application of the headless screw is also located in the supporting device on a relatively small diameter, so that the supporting device can be unintentionally and unnoticeably displaced (lever action) while screwing on an expansion head with a much larger diameter. Finally, the headless screw leaves a mark at the point of application, i.e. a deformation into which the headless screw engages again, even if a slightly different setting is desired.

The accurate and reliable set-up of the expansion heads and the expansion path is desirable for four reasons:

1. For the rectification of all manufacturing tolerances of all parts of the basic device;
2. For the rectification of dimensional discrepancies between the basic devices and the expansion heads with different production dates, and from different manufacturers and suppliers;
3. For the rectification of manufacturing tolerances (diameter and wall thickness) of the workpieces (pipes) and/or
4. For the adjustment of the so-called capillary slit between the expanded pipe end and the non-expanded pipe end placed in the same, in the case of welded or glued connections used in pipe line construction (capillary optimization: secure welded or glued connections with minimum use of welding or glue).

Therefore, the object of the invention is to offer a tool of the above described type, which allows a particularly simple, reliable and reproducible set-up of the expansion head. The invention offers a solution to the problem with the above described flaring tool because the supporting device has index boreholes for an index pin found in the annular flange in a circle concentric to the (A—A) axis, the pin being located in the basic tool body.

The invention allows a reproducible set-up, particularly when the index boreholes are, for instance, marked alphanumerically. In that case it is possible to assign each pipe wall thickness and each expansion head with certain codes, which in turn have different tolerance zone positions, e.g. for back-orders of additional expansion heads. The index pin ensures a definite and reliable stop on a relatively large diameter so that the torsional movement acting on the supporting device during the changing of expansion heads cannot cause a unwanted or unnoticed displacement. In addition, there is no material deformation on the action points of the stopping device in the supporting device. The large diameter also allows an indexation with fine graduation.

The index pin should preferably be in the shape of a stepped cylinder, having a first and a second cylinder surface placed coaxially to each other forming a ring shoulder, where the index pin is located in complementary coaxial tapholes in the basic tool body, and where a prestressed pressure spring is located between the bottom of the taphole with the larger diameter and the ring shoulder, and the index pin with the cylinder surface with the larger engages in the index borehole of the supporting device built in the shape of a rotation body.

For space saving reasons the smaller cylinder surface of the index pin protrudes from the basic tool body and has a sliding key on the end of this cylinder surface.

Also the driving mechanisms can be different. The expanding mandrel can be driven by a hydraulic piston, for example.

A particularly advantageous application, however, is in the case of "expanding clamps", which in the closed position has two hand levers in vertical position to the axis of the expanding mandrel. In this case the basic tool body has a first rigidly installed hand lever and a swivelling control body, which acts on the expanding mandrel and is connected to a second swivelling hand lever, which is located in the basic tool body in a slit between two bearing blocks. For the protection of the sliding key, the latter is guided in a slit between the bearing blocks, protruding from the slit on the side facing away from the hand levers.

An example of the invention is explained below in more detail with reference to FIGS. 1 and 2.

Referring to the drawing:

FIG. 1 is a partial axial sectional view through a flaring tool in the area of the basic tool body and the expanding mandrel with the expansion head; and FIG. 2 is a fragmentary, sectional view of a portion of the FIG. 1 tool to enlarged scale.

FIG. 1 represents a flaring tool 1 for the ends of hollow cylindrical workpieces (pipes), which has a basic tool body 2 made of metal with a first hand lever 3 built in one piece, a taphole 4 and an axially adjustable supporting device 5 placed inside the same, intended for an expansion head 6.

The supporting device 5 comprises a rotation body 7 with a first extension 8 with an external thread 8*a*, which is to a large extent screwed into the taphole 4. This threaded connection serves to achieve the above mentioned axial adjustment. In addition the rotation body 7 has second extension 9 with an external thread 9*a* to support the expansion head 6. Between the first and the second extension is a stop built in one piece 10 in the shape of an annular flange 11. The rotation body 7 has an axial taphole 12 in which an expanding mandrel 13 is located, which has a tapered end 13*a* in the shape of a truncated cone, which causes the expansion of the expansion jaws when it is moved in longitudinal direction.

On the outside end of the second extension 9 is a radial frontal area 9*b* for the radial guiding of the sector shaped expansion jaws 14, of which six are located forming a set in a circle around the A—A axis.

For the above described guiding, each of the expansion jaws 14 have a flange sector 14*a*, which is supported with a rivet 15 in a screw cap 16, and can be radially displaced. An annular ring 14*b* surrounding the flange sectors keeps the prestressed expansion jaws 14 together in the direction of the A—A axis. The screw cap 16 has an internal thread 16*a* and an annular flange 16*b* with a ring shaped area 16*c*, on which the flange sectors 14*a* can glide. The screw cap 16 abuts with its rim 16*d* on the stop 10 and the annular flange 11, and the axial distance between the rim 16*d* and the ring shaped area 16*c* on the one hand, and the distance between the frontal area 9*a* and the annular flange 11 on the other hand, has been chosen in such manner that a slit, limited by plane parallel surfaces, is formed between the frontal area 9*a* and the ring shaped area 16*c*, into which the flange sectors 14*a* glide with sufficient play.

The tapered end 13*a* of the expanding mandrel protrudes from the taphole 12 and plunges coaxially into the set of expansion jaws 14. On the opposite end of the expanding mandrel 13, which also protrudes from the basic tool body 2, a free turning roller 18 is located by means of a cylindrical roller axis 17, whose axis of rotation is vertical to the mandrel axis A—A, which is also the system axis.

The basic tool body 2 has a guide 2*a*, approximately in the shape of a square with rounded exterior corners and edges. The expanding mandrel 13 protrudes with the roller 18 up from the guide 2*a*. Between the guide 2*a* and the rigid one-piece hand lever 3 is a transition piece 2*b* with the corresponding slanted outside wall surfaces, which avoids steps and kinks. These details are not shown in the drawings. The guide 2*a* and the transition piece 2*b* have a slit shaped recess 2*c* open on the top, into which plunges the control body 19, which is described in more details below.

Also in the basic tool body 2 and by means of a swivelling axis 20, is located the control body 19 which acts on the roller 18, and which is connected with a second, swivelling hand lever 21, forming one piece.

By means of the control body 19, the expanding mandrel 13 can be displaced clockwise, using the levers, into the position shown in FIG. 1 at a preset stroke, emerging from the rotation body 7 and moving against the expansion head 6, which is connected with the supporting device 5. This phase of the operation of the expansion head is known from prior art; therefore this point does not require further discussion.

The clarifications "above" and "below" refer to the location shown in the figures.

The control body 19 has a slit 22 traversing from one side to the other, which runs in an arch around the swivelling axis 20, and which is limited on one side by a first cam 23 and on the opposite side by a second cam 24. The inside width of the slit 22 corresponds at each point to the diameter of the roller 18 (plus a small play), so that the roller 18 is enclosed in the slit 22 and is forcibly guided in both directions of movement of the expanding mandrel.

The roller 18 runs on the first cam 23 during the expansion process, and on cam 24 when the expanding mandrel 13 withdraws due to the lever movement in the opposite sense.

The roller 18 is located by means of a roller axis 17 in and between the two side plates 13*b* of the expanding mandrel 13, limited inside by two parallel walls. Only the front side plate is visible.

The cams 23 and 24 are connected by two end surfaces in the shape of a concave half cylinder, with the arch shaped slit 22, whose centers of curvature—which in both possible end positions alternatively coincide with the axis of the roller 18—are at different distances from the swivelling axis 10 depending on the stroke of the expanding mandrel 13. The curve path is monotonous, i.e. the expanding mandrel will not run twice through a position when the control body 19 is rotated in one direction.

The mentioned end surfaces in the shape of half cylinders form stops which limit the swivel angle of the swivelling hand lever 21, where one stop limits the approximation of the hand levers to a minimum distance, thus avoiding finger catching. The other stop limits the opening movement of the hand lever.

The control body 19 forms one end of the swivelling hand lever 21 and has an eyelet 25 for its placement on the swivelling axis 20. This axis penetrates a slit 26 in the basic body 2, and is located in the latter on the side, outside of the expanding mandrel 13 on the opposite side from the hand levers 3 and 21, on both sides of the slit 26 in the basic body 2. The side walls of the basic body limiting the slit 26, of which only the back wall is visible, can also be described as bearing blocks for the swivelling axis 20. The side plates serve as additional guides for the expanding mandrel 13, thanks to partially cylindrical recesses (not visible) located in the same.

The rotation body 7 has a frontal area 27 radial to the A—A axis between the annular flange 11 and the first extension 9, with index boreholes 28 in a concentric circle to the A—A axis, of which only those located in the sectional plane are visible. An index pin 29 located in the basic tool body 2 engages in these boreholes. The index boreholes 28 and the index pin 29 together form a stopping device 30, whose details are more clearly visible in FIG. 2.

The index pin 29 has the shape of a stepped cylinder and has a first and second cylinder surface 29*a* and 29*b*, which are arranged coaxially to each other forming a ring shoulder 29*c*. The axis of the index pin runs parallel to the A—A axis. Together with the cylinder surfaces, the index pin is placed in complementary axial boreholes 31 and 32 in the basic tool body 2. Between the bottom of the borehole 31 with the larger diameter and the ring shoulder 29*c*, is a prestressed pressure spring 33, which keeps the index pin 29 with the cylinder surfaces 29*a* with the larger diameter in the respective, preselected index borehole 28.

The index pin protrudes with the cylinder surface 29*b* with the smaller diameter from the upper part of the basic tool body 2, and has on the end of this cylinder surface 29*b* a sliding key 34. This sliding key is guided with little play into the above described slit 26, and is secured against twisting turning, protruding on the side facing away from the hand levers 3 and 21 from the slit 26.

The form of operation of the apparatus is the following: With the index pin 29 notched in, an expansion head 6 is first screwed on to the external thread 9*a*, and is tightened by hand, i.e. without tools, against the annular flange 11.

Then it is checked, in the idle stroke, if the hand levers can be brought together without using force. If this is not the case, the index pin 29 is lifted using the sliding key 34, and the rotation body 7 together with the expansion head is turned slightly until it emerges from the basic body 2; this normally requires a rotation of 30 to 90 degrees, i.e. the distance of two to four index boreholes.

Then a trial expansion is conducted, and the capillary slit for the pipe mating is measured. Depending on whether the capillary slit is too large or too small, it can be increased or reduced by jointly turning the rotation body 7 and the expansion head 6 in one or the other turning direction. The apparatus is now ready for any number of work operations, and the index pin prevents unintentional displacements.

The adjusting procedure can be facilitated with a dial with direction indicators ("larger"/"smaller").

Alternatively, it is possible to place the threaded extension 8 not in the supporting device 5 but in the basic tool body 2, so that it sticks out below, and to provide the supporting device 5 with the respective taphole similar to the taphole 4, only in opposite direction. Also in this case the diameter of the adjustable thread 4/8*a* is clearly smaller than the diameter of the external thread 9*a* intended for the mounting of the expansion heads, and the supporting device is not an adapter located in each expansion head, but a part permanently associated with the basic apparatus.

While there has been described what is at present considered to be the preferred embodiment of this invention, it will be obvious to those skilled in the art that various changes and modifications may be made therein without departing from the invention, and it is, therefore, aimed to cover all such changes and modifications as fall within the true spirit and scope of the invention.

What is claimed is:

1. Flaring tool for hollow, in particular for cylindrical hollow workpieces, comprising: a basic tool body, an axially displaceable expanding mandrel with a tapered end, and a supporting device, concentrically surrounding the expanding mandrel, for an exchangeable expansion head, having a drive with the help of which the expanding mandrel can be displaced against the expansion head at a predetermined stroke, the expansion head comprising a screw cap, which can be mounted on the supporting device and a set of expansion jaws which can be guided radially inside the screw cap, the supporting device being placed by means of a threaded extension in the direction of an (A—A) axis of the expanding mandrel in the basic tool body and being displaceable in longitudinal direction, and which supporting device has an annular flange serving as a stop for the expansion head, and a stopping device which acts on a displacement movement of the supporting device opposite the basic tool body, the supporting device having index boreholes placed in the annular flange in a concentric circle to the (A—A) axis, and an index pin which is located in the basic tool body, axes of the index boreholes and the index pin running parallel to the (A—A) axis of the expanding mandrel.

2. Flaring tool according to claim 1, in which the index pin has the shape of a stepped cylinder with a first and a second cylinder surface, which are arranged coaxially to each other forming a ring shoulder, and together with which the index pin is located in complementary coaxial tapholes in the basic tool body, and which tool includes a prestressed pressure spring located between the bottom of the taphole with the larger diameter and the ring shoulder and index pin with a cylinder surface with a larger diameter engaging in the index borehole of the annular flange.

3. Flaring tool in accordance with claim 1, in which the index pin protrudes from the basic tool body with a cylinder surface with a smaller diameter, and the index pin (29) having a sliding key being at the end of this cylinder surface.

4. Flaring tool according to claim 3, in which the basic tool body has two bearing blocks having a slit therebetween and in which the sliding key is guided in the slit between two bearing blocks of the basic tool body, secured against twisting turning, and protrudes from the slit.

* * * * *